US006415458B1

(12) United States Patent
McFadden

(10) Patent No.: US 6,415,458 B1
(45) Date of Patent: Jul. 9, 2002

(54) SHAMPOOING DEVICE

(76) Inventor: Christopher P. McFadden, 2676 Salmon St., Philadelphia, PA (US) 19125

( * ) Notice: Subject to any disclaimer, the term of this patent is extended or adjusted under 35 U.S.C. 154(b) by 0 days.

(21) Appl. No.: 09/803,820

(22) Filed: Mar. 12, 2001

(51) Int. Cl.[7] ..... A45D 44/08
(52) U.S. Cl. ..... 4/521; 4/520
(58) Field of Search ..... 4/520, 521, 519, 4/518, 515, 523; 2/174, 171, 50, 48

(56) References Cited

U.S. PATENT DOCUMENTS

| | | | | |
|---|---|---|---|---|
| 121,921 A | | 12/1871 | Winn | |
| 835,814 A | * | 11/1906 | Dalton | 4/521 |
| 1,429,950 A | * | 9/1922 | Rose et al. | 4/515 |
| 1,438,099 A | * | 12/1922 | De Velasco | 4/521 |
| 2,850,742 A | | 9/1958 | Glintz | |
| 3,996,946 A | * | 12/1976 | Craig | 132/9 |
| 4,014,054 A | | 3/1977 | Pasquarello | 4/159 |
| 4,216,551 A | | 8/1980 | Pasquarello | 4/521 |
| 5,022,102 A | | 6/1991 | Louvaris | 5/516 |
| 5,146,629 A | | 9/1992 | Barnes | 2/174 |
| 5,305,481 A | | 4/1994 | Nebb | 4/516 |
| 5,551,088 A | | 9/1996 | Stepp | 2/174 |
| 5,946,745 A | | 9/1999 | Magee | 4/522 |
| 5,953,768 A | | 9/1999 | Jarosz et al. | 4/522 |

FOREIGN PATENT DOCUMENTS

| | | | | |
|---|---|---|---|---|
| FR | 2600871 A1 | * | 1/1988 | 4/521 |

* cited by examiner

*Primary Examiner*—Gregory Huson
*Assistant Examiner*—Huyen Le
(74) *Attorney, Agent, or Firm*—Synnestvedt & Lechner LLP

(57) ABSTRACT

A portable shampooing device includes a basin defining a central opening and a sleeve of elastic, liquid impermeable material. The sleeve defines a first periphery joined to the basin around the opening for admitting passage of a human head. The sleeve also defines a second periphery smaller than the first periphery for fitting around a human neck, preferably at the chin or just below the chin. Optionally, the basin may define a funnel portion and include a drainage tube attached to the funnel portion. The device may also include a collar joined to the sleeve adjacent the second periphery and having a fastener for securing the collar around the neck and forming a tight seal. A cushion may be joined to the basin to provide comfort to a wearer of the shampooing device.

24 Claims, 6 Drawing Sheets

12
16
35
38
14
34
36
20
26
28
A
35
14
34

D
22
41
35
14
34
38
B
39
C
39

SHAMPOOING DEVICE

FIELD OF THE INVENTION

The present invention relates generally to hair washing or shampooing devices. In particular, the present invention relates to a portable device which permits washing or shampooing of a person's hair while the person maintains an inclined or upright position.

BACKGROUND OF THE INVENTION

Traditional professional washing or shampooing (collectively, "shampooing") of a person's hair is performed with the use of a contoured sink. This creates a need for the person to approach or position the person's neck in a neck-receiving portion of the contoured sink. Such positioning typically requires sharp backward bending of the person's neck. This is often inconvenient, uncomfortable, or impossible, particularly for hospital or nursing home patients with limited mobility. Additionally, such sharp bending of the neck results not only in discomfort due to increased pressure on the neck, but also in restriction of blood flow, e.g. in the vertebral artery, which can result in unconsciousness or a stroke, which is highly undesirable.

A variety of portable shampooing devices are disclosed in the prior art. Some of these, such as those disclosed in U.S. Pat. No. 2,850,742 to Glintz and U.S. Pat. No. 5,305,481 to Nebb, are essentially portable sinks which require a person to assume a reclined or other uncomfortable position, which may be impossible for patients with limited mobility.

Others of these devices permit shampooing in an inclined or upright position. For example, U.S. Pat. No. 4,216,551 to Pasquarello discloses a portable shampoo apparatus contoured to fit adjacent a person's neck and to facilitate the shampooing process. This device is an "open" system in that it causes immediate drainage away from the juncture with the person's body or hair (hereinafter, the "seal") and down a back portion of the device and into a sink. The seal is typically the primary source of leakage. In this manner, water never tends to collect or "stand" around the seal with the patient's head. Such an arrangement is unsatisfactory for patients, such as bedridden patients, who cannot approach a sink. Although this Pasquarello device permits shampooing in the upright position, it is particularly prone to leak and wet the patient's clothes, which is highly undesirable.

Various "open" system portable devices for facilitating the shampooing process are known for fitting around a patient's head. Examples are shown in U.S. Pat. No. 5,146,629 to Barnes, U.S. Pat. No. 5,551,088 to Stepp and U.S. Pat. No. 5,953,768 to Jarosz, et al. These devices are typically fit around a patient's head, along or beneath the hairline, and serve to divert water or other liquids away from the patient's body and clothing. Because of the presence of hair along the hairline, maintaining a proper seal is difficult, so leakage is common. An extremely tight seal may minimize or prevent leakage but may also cause discomfort to the patient and/or inhibit blood flow, which is particularly undesirable. Additionally, such arrangements are typically multi-piece and complex. As mentioned above, such devices are undesirable in some applications because a sink is unavailable.

U.S. Pat. No. 5,022,102 to Louvaris discloses an inflatable device for sealing around a patient's hairline and neck. This device causes water to flow toward and collect at the seal with the patient's head/hairline, which tends to cause leakage. The device is essentially an open system, although the water may be collected in a reservoir below the height of the seal, which helps to reduce leakage.

U.S. Pat. No. 121,921 to Winn discloses a complex "closed" system device for sealing around a person's hairline. The "closed" system has a drainage tube but acts as a reservoir and causes water to collect around the seal with the patient's head, which causes leakage. This is ameliorated by use of a supplemental device worn around the patient's neck to catch leakage from above. This multi-piece, leakage prone device is undesirable.

U.S. Pat. No. 4,014,054 to Pasquarello discloses a shampoo device for fitting around a person's neck. The device fits adjacent the patient's neck, but has a belt-like closure for looping around the patient's neck to form a seal. The closure includes a tie string or the like to maintain the seal around the base of the patient's neck. The device is essentially an open system. However, the design causes water to flow toward the seal at the base of the patient's neck and collect, which creates a leakage problem.

U.S. Pat. No. 5,946,745 to Magee discloses a closed system which acts as a reservoir and does not require a patient to assume a position adjacent a sink. The Magee device is a complex multi-piece system which is coupled with a cape having a drawstring to facilitate a seal around the neck. The cape is fitted around the base of the neck beneath the bowls of the device. The patient must keep constant tension on the drawstrings to prevent leakage. This is undesirable for unconscious patients or patients incapable of maintaining such constant tension, as leakage will result. Alternatively, more than one person would have to participate in the shampooing procedure to ensure that the patient's clothes remain dry, which is highly undesirable because of the time and costs associated with employing additional personnel to perform the shampooing procedure. Additionally, water is caused to flow toward the seal with the patient's neck and allowed to collect. This causes a leakage problem. This is ameliorated in part by the provision of a reservoir below the seal with the patient's neck. However, water in the reservoir makes the device heavy and unstable, which makes it difficult or impossible for patients to support and which increases the risk of water spillage due to instability of the reservoir.

SUMMARY OF THE INVENTION

The present invention provides a portable shampooing device including a basin defining a central opening for admitting passage of a human head. The basin also includes a sleeve of elastic, liquid impermeable material defining a first periphery joined to the basin around the opening to form a watertight seal. The sleeve also defines a second periphery smaller than the first periphery for fitting around a human neck, preferably at the chin or just below the chin. Accordingly, the present invention provides a simple, portable shampooing device which fits entirely around the patient's head and neck. The present invention drastically reduces and/or eliminates leakage by providing a tight seal around any irregular contours of an upper portion of the patient's neck. This promotes drainage away from the seal with the patient's body and maintains the seal with the patient's body above any collected water, which substantially reduces leakage. Additionally, the present invention does not require the patient or the shampoo assistant to exert any effort to maintain the seal, making the device suitable for assistance-free use with unconscious or incapacitated patients.

Any draining water running from the head over the seal with the patient's body does not cause a significant leakage risk. However, the shampooing device may optionally include a collar joined to the sleeve adjacent the second periphery and having a fastener for securing the collar around the neck. The fastener may include hook and loop material to ensure a tight seal. This further reduces any leakage risk. Additionally, a cushion may optionally be joined to an underside of the basin for distributing the weight of the device along the patient's neck and/or shoulders. The shampooing device may also include a funnel portion and/or a drainage tube attached to the funnel portion in a closed system embodiment. Alternatively, the device may include a sluice portion in an open system embodiment.

DETAILED DESCRIPTION

Figure 1:
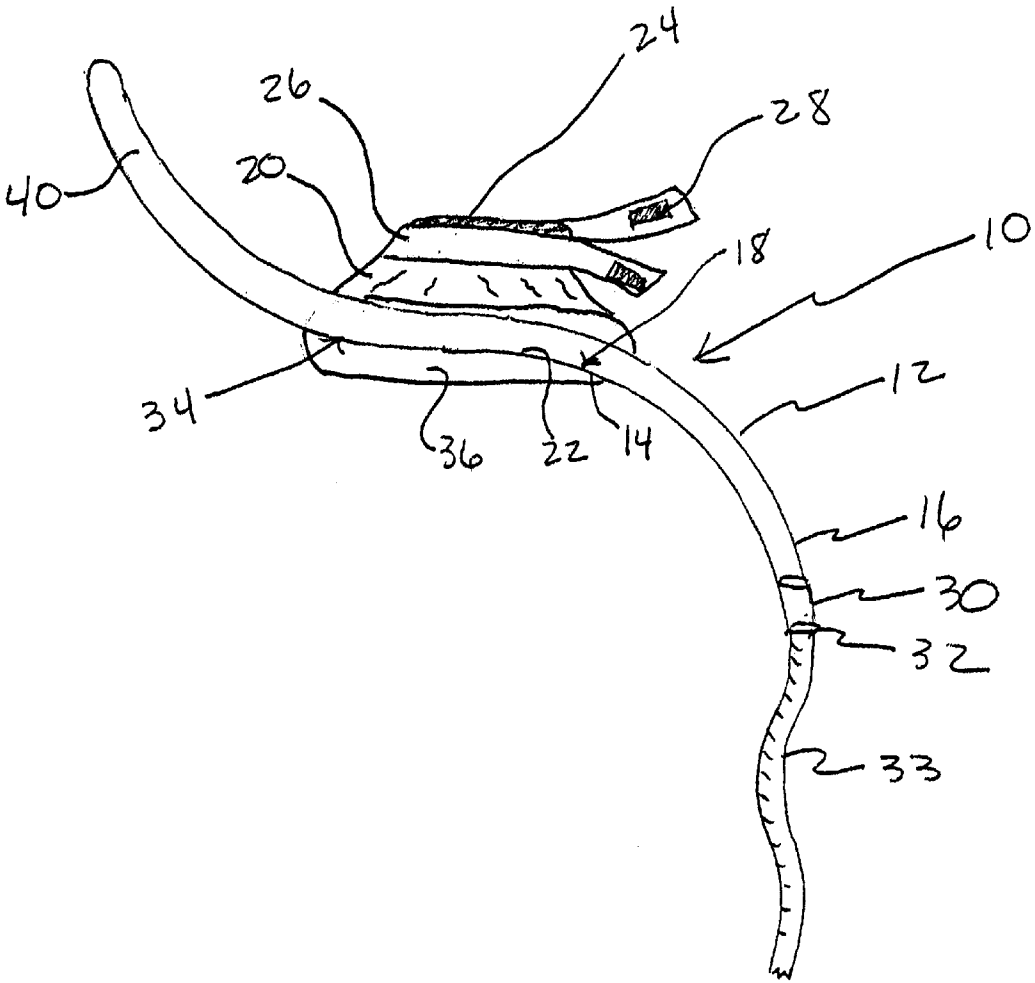
FIG. 1 is a side elevational view of an exemplary shampooing device in accordance with one embodiment of the present invention.

FIG. 1 is a side elevational view of an exemplary shampooing device 10 in accordance with one embodiment of the present invention. The shampooing device 10 includes a basin 12 having a bottom wall 14. The basin is constructed of a rigid or semi-rigid waterproof material, such as plastic, e.g. polyvinyl chloride. The basin 12 is most preferably transparent to the human eye to permit minimal obstruction of a wearer's or shampooer's vision. A substantially rectangular bottom wall 14 measuring approximately 13 to 15 inches wide by approximately 20 inches long has been found to be suitable. Preferably the bottom wall 14 is tapered toward one end, as best shown in FIG. 2.

Figure 2:
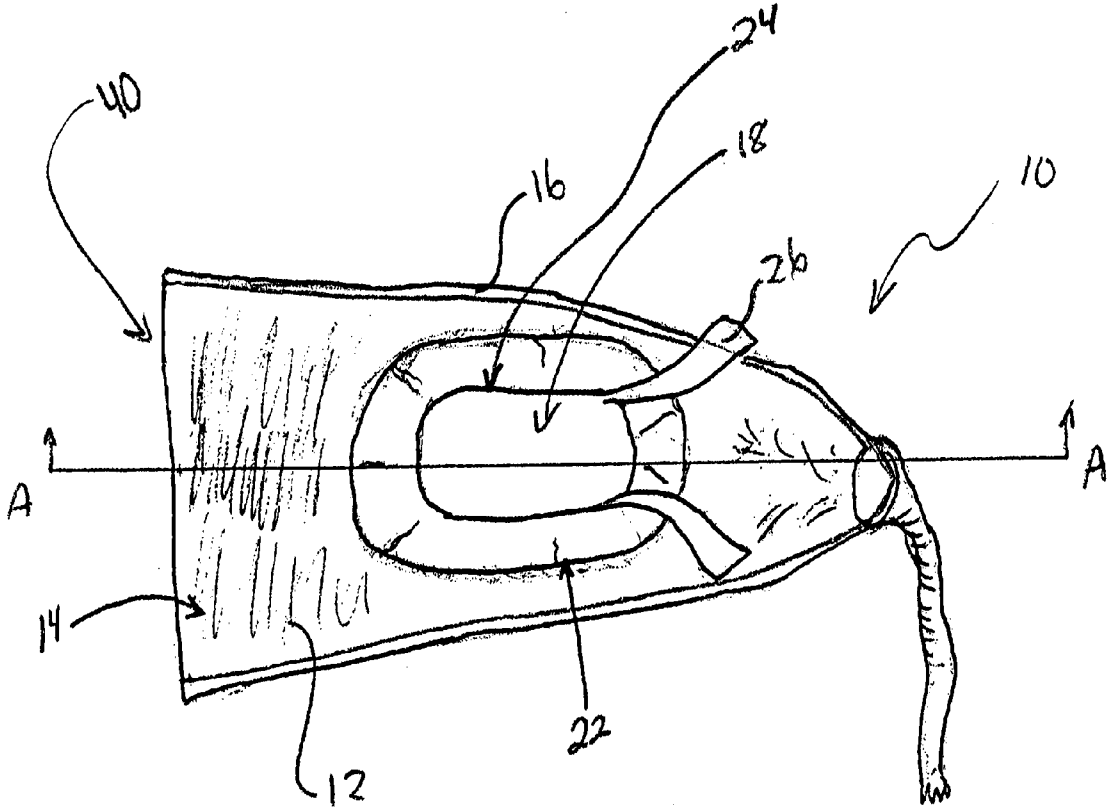
FIG. 2 is a top view of the exemplary shampooing device of FIG. 1.

The bottom wall 14 defines a centrally-located first opening 18, as best shown in FIG. 2. The central opening 18 is dimensioned to permit passage therethrough of a human head. A circular opening having a diameter of approximately 11 inches has been found to be suitable for accommodating most human heads.

In the example of FIG. 1, the device 10 includes a continuous sidewall 16 extending upwardly along substantially all of the bottom wall 14. The sidewall 16 is continuous in that is completely encloses at least a portion of the bottom wall 14 to define a basin 12 capable of retaining fluids. A sidewall 16 having a height of approximately 3 inches has been found to be suitable.

The shampooing device 10 also includes a sleeve 20 of elastic, liquid impermeable material. The sleeve material should be supple and highly elastic to easily stretch to pass a human head and conform closely to any irregular contours of a human neck. For example, the sleeve 20 may be made of a latex or non-latex rubber. Many people are allergic to latex, so a hypoallergenic material, such as a non-latex material, is preferred.

Figures 3, 3A:
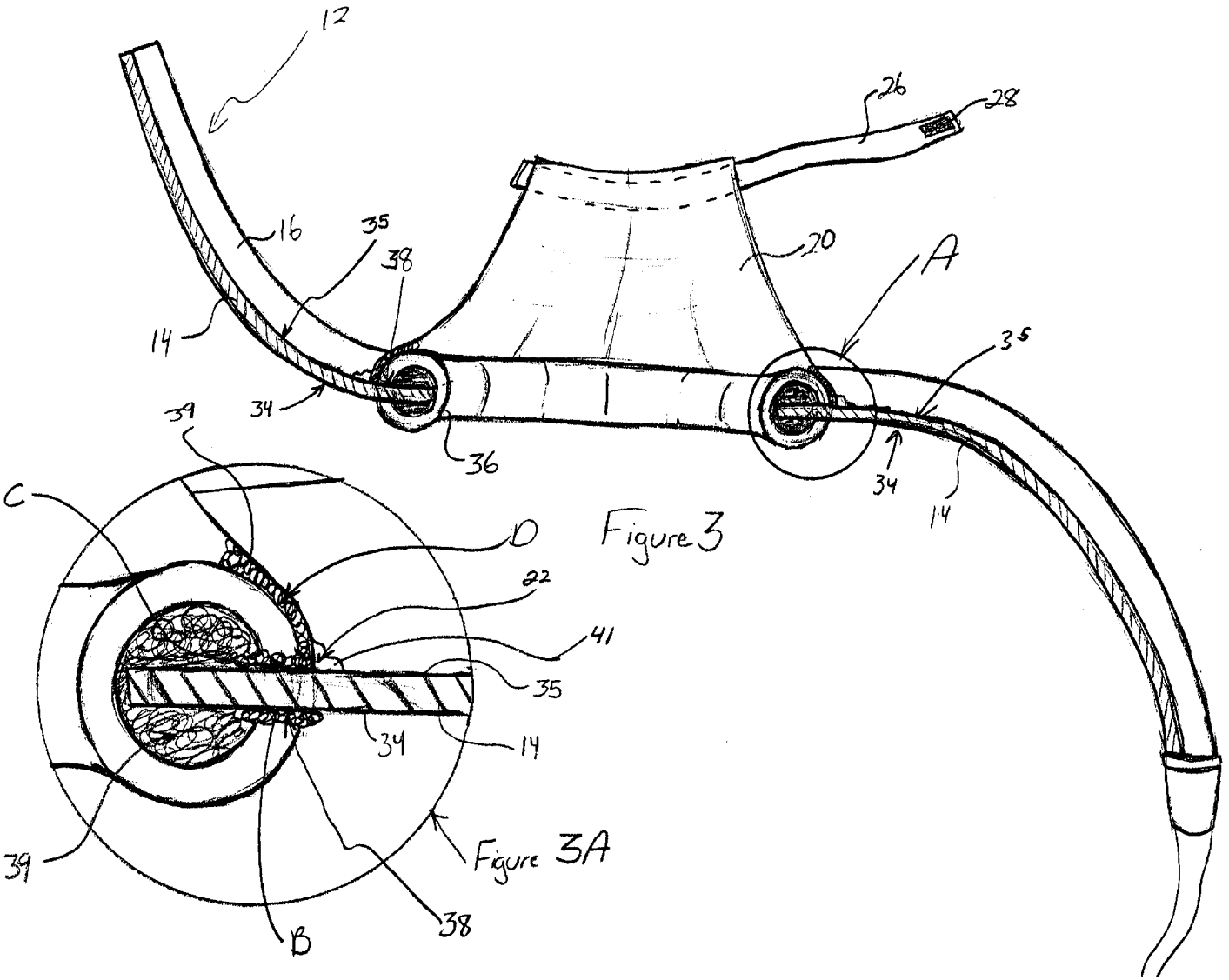
FIG. 3 is a cross-sectional view of the exemplary shampooing device of FIG. 1, taken along line A—A of FIG. 2.
FIG. 3A is an enlarged detail cross-section view of portion A of FIG. 3.

The sleeve 20 defines a first periphery 22 as best shown in FIGS. 2 and 3. For example, the sleeve 20 may be formed by joining the two short edges of a substantially rectangular or trapezoidal sheet of material. Alternatively, the sleeve 20 may be formed in a tube or a truncated cone. A sleeve having a height of approximately 4–5 inches when held substantially erect has been found to be suitable. The first periphery 22 of the sleeve 20 is joined to the basin 12 around the first opening 18 to form a liquid impermeable seal therewith, as shown in FIG. 3. For example, a bead silicone sealant may be placed adjacted the first periphery 22 of the sleeve 20 to join the sleeve 20 to the basin 12. Various techniques for joining the sleeve 20 to the basin 12 and forming a waterproof seal therebetween are well known in the art.

The sleeve 20 further defines a second periphery 24 smaller than the first periphery 22. The second periphery 24 is dimensioned to permit expansion to fit over the human head and subsequent contraction to closely fit a human neck. A second periphery of approximately 4–5 inches in diameter has been found suitable for this purpose.

In the embodiment shown in FIG. 1, the shampooing device 10 includes a collar 26 joined to the sleeve 20 adjacent the second periphery 24. In the embodiment shown in FIG. 1, the collar 26 is attached to the outside of the sleeve 20 and so will not contact the patient's skin. In such an embodiment, it is preferred that the sleeve 20 be constructed of a hypoallergenic materials, although the collar 26 need not be, to prevent an allergic reaction to a individual wearing the device. In an alternate embodiment, an edge of the collar 26 is joined to the second periphery of the sleeve 20, so the collar 26 will contact the patient's skin. In such an embodiment, it is preferable that the collar be constructed of a hypoallergenic material, although the sleeve 20 need not be. However, it is preferable that both the sleeve 20 and the collar 26 be constructed of hypoallergenic materials to prevent the possibility of allergic reactions to wearers of the device 10. Alternatively, the sleeve 20 may include extensions capable of acting as a collar, such that the sleeve 20 and collar 26 are integrally formed from a single sheet of material.

The collar 26 includes a fastener 28 for securing the collar 26 to form a tight seal around the patient's neck. The fastener preferably includes hook and loop fastener material because such material provides a great degree of flexibility in forming a tight seal with necks of various sizes.

Figure 4:
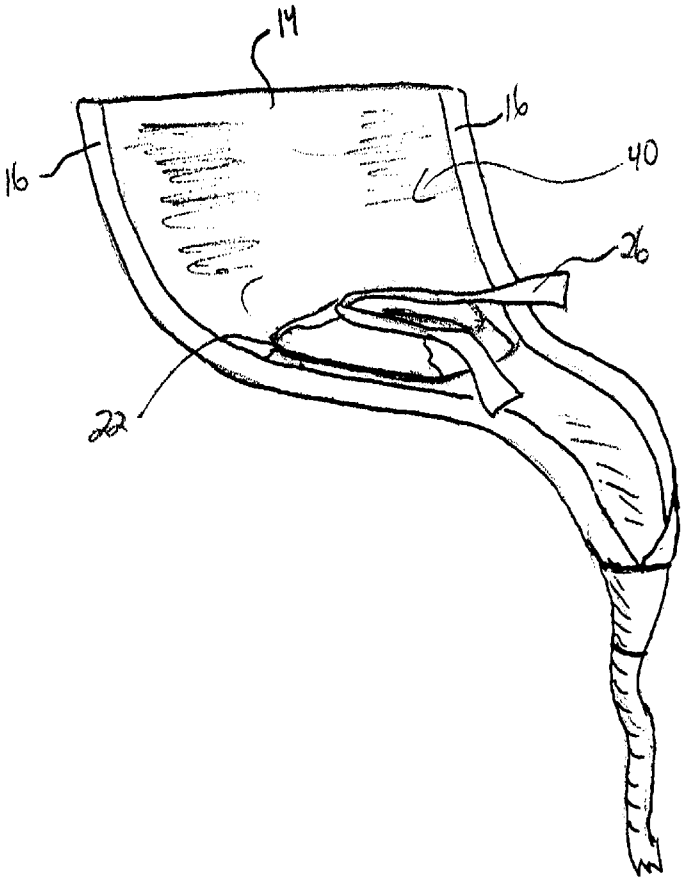
FIG. 4 is a side elevational view of the exemplary shampooing of FIG. 1.

The shampooing device 10 shown in FIG. 1 has a continuous sidewall 16 extending along at least a portion of the basin 12 to define a reservoir for collecting water, as best shown in FIG. 2. Accordingly, the device 10 defines a second opening for draining the basin 12. In the exemplary shampooing device shown in FIG. 1, the bottom wall 14 and sidewall 16 of the basin 12 cooperate to define a funnel portion 30 and the second opening 32 is defined by the funnel portion 30, as shown in FIG. 4. A drainage tube 33 is integrally joined to the funnel portion 30 around the second opening 30. Preferably, the drainage tube is thin-walled and approximately 1 inch in diameter to permit rapid drainage.

In one alternate embodiment, the drainage tube 33 is removably attachable to the funnel portion 30, e.g. by a friction fit. In another alternate embodiment, the basin defines a second opening substantially in the plane of the bottom wall 14 and the drainage tube 33 fits around the second opening. Optionally, the drainage tube 33 may include the funnel portion. Techniques for making suitable connections of the drainage tube 33 to the basin 12 are well known to those skilled in the art.

Preferably, the basin 12 defines an underside 34 and includes a cushion 36 joined to the underside 34 of the basin adjacent the first opening 18. For example, the cushion 36 may include closed cell foam. In one embodiment, the cushion 36 has a substantially tubular cross-section and extends around the first opening 18 as best shown in FIGS. 2 and 3. In this embodiment, the cushion 36 defines a curved loop, the ends of which are separated by a longitudinal slit 38 into which the bottom wall 14 is fitted, as shown in FIGS. 3 and 3A. The cushion 36 is then joined to the bottom wall 14, e.g. by contact cement 39, silicone sealant, or in any other suitable manner. In the embodiment shown in FIGS. 3 and 3A, the cushion 36 is joined to the underside 34 of the bottom wall at B and to the top side 35 of the bottom wall 14 at D. Preferably, the cushion 36 is joined to sleeve 20, e.g. by contact cement 39, as shown generally at C in FIG. 3A, and a bead 41 of silicone sealant is provided adjacent the sleeve 20 and the top side 35 of the bottom wall 14, as best shown in FIG. 3A, to ensure a waterproof seal between the sleeve 20 and the basin 14. Any suitable means of ensuring a waterproof seal between the sleeve 20 and the basin 14 may be used. For example, the sleeve 20 may be bonded to the bottom wall by the contact cement 39 and/or the silicone sealant to form a liquid impermeable seal therewith as shown in FIG. 3A.

Figure 5:
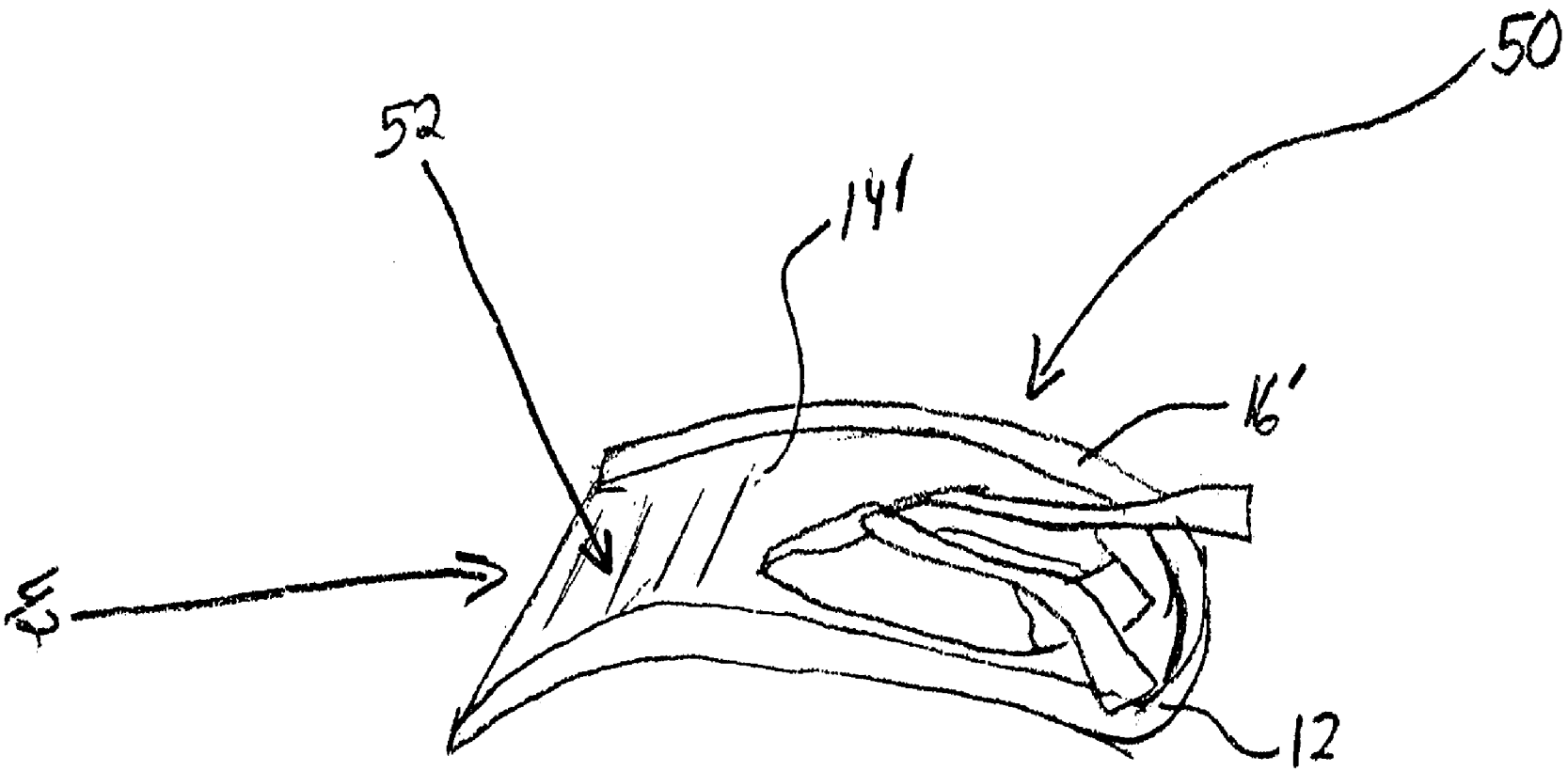
FIG. 5 is a side elevational view of an exemplary shampooing device in accordance with an alternate embodiment of the present invention.

FIG. 5 is a side elevational view of an exemplary shampooing device 50 in accordance with an alternate embodiment of the present invention. The shampooing device 50 in FIG. 4 is substantially the same as the shampooing device 10 shown in FIG. 1, but it is of an open design. In other words, it does not form a reservoir but rather is open in the back 42 and the bottom wall 14' of the basin 12 forms a sluice portion 52 for draining into a sink or the like. In such an embodiment, a second opening, funnel portion and/or drainage tube is unnecessary.

Figure 6:
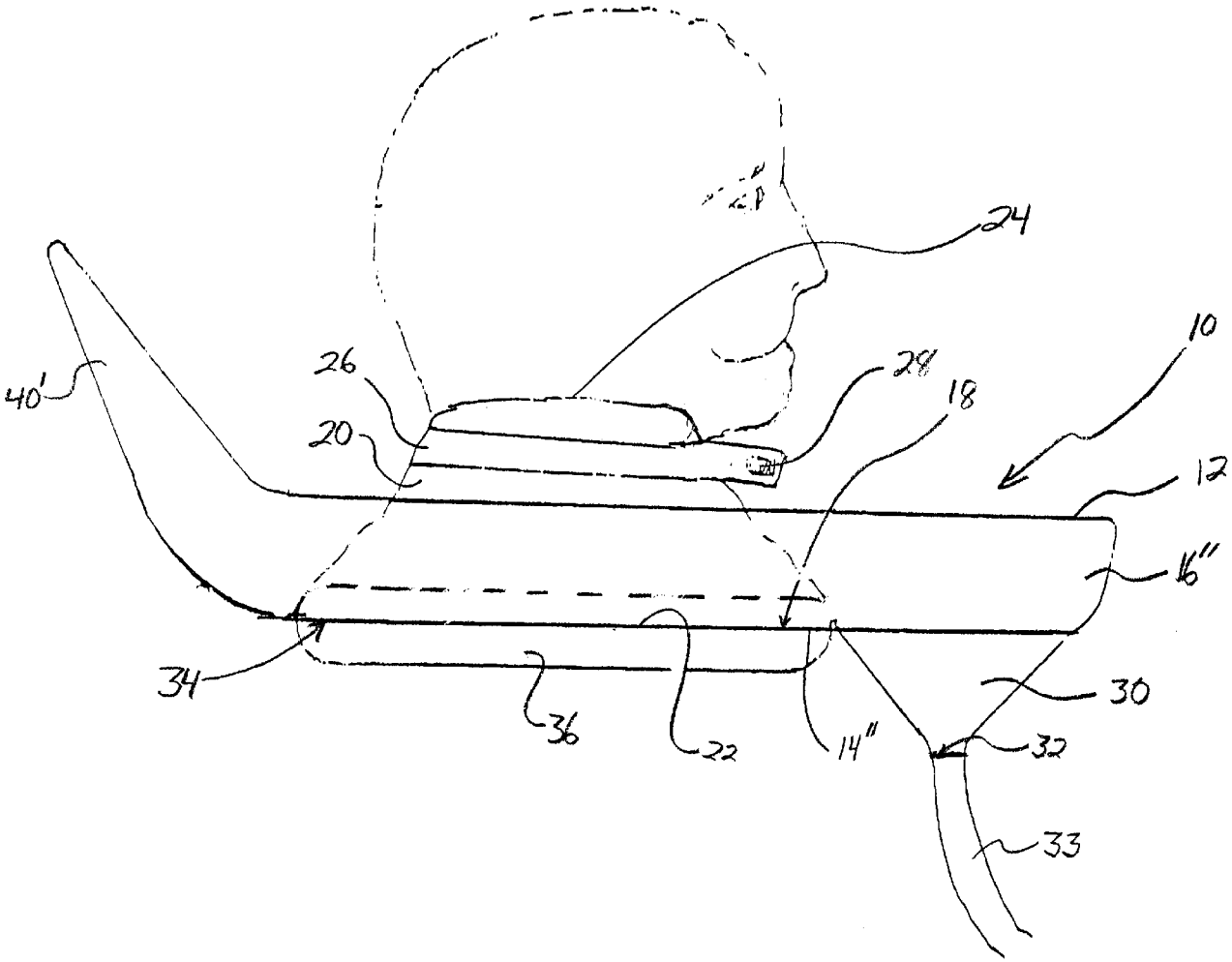
FIG. 6 is a side elevational view of an exemplary shampooing device in accordance with yet another embodiment of the present invention.
Figure 1:
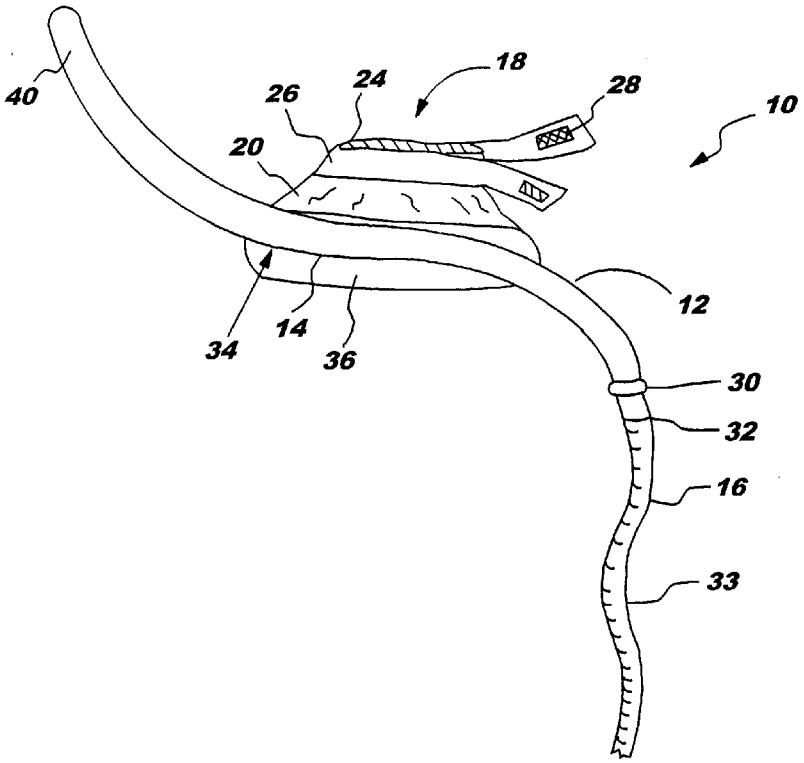
Figure 2:
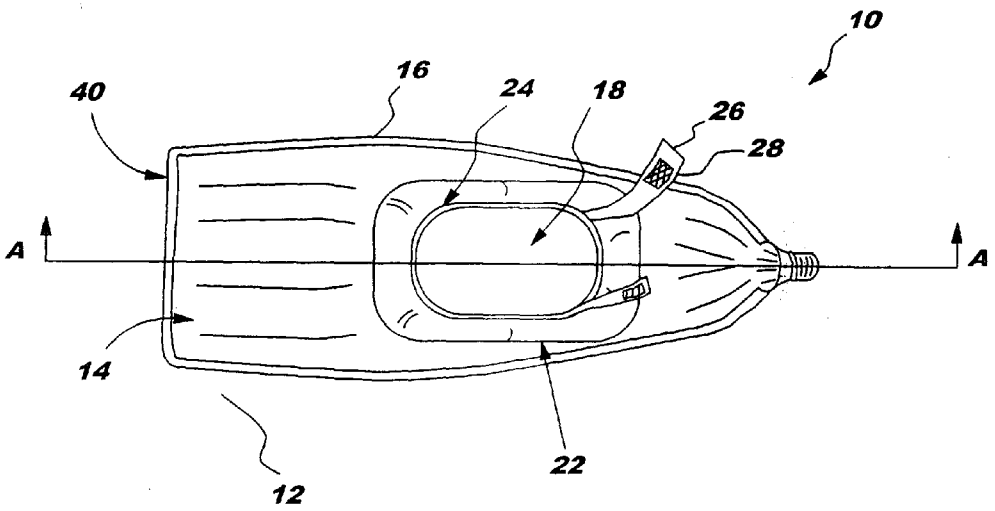
Figure 3:
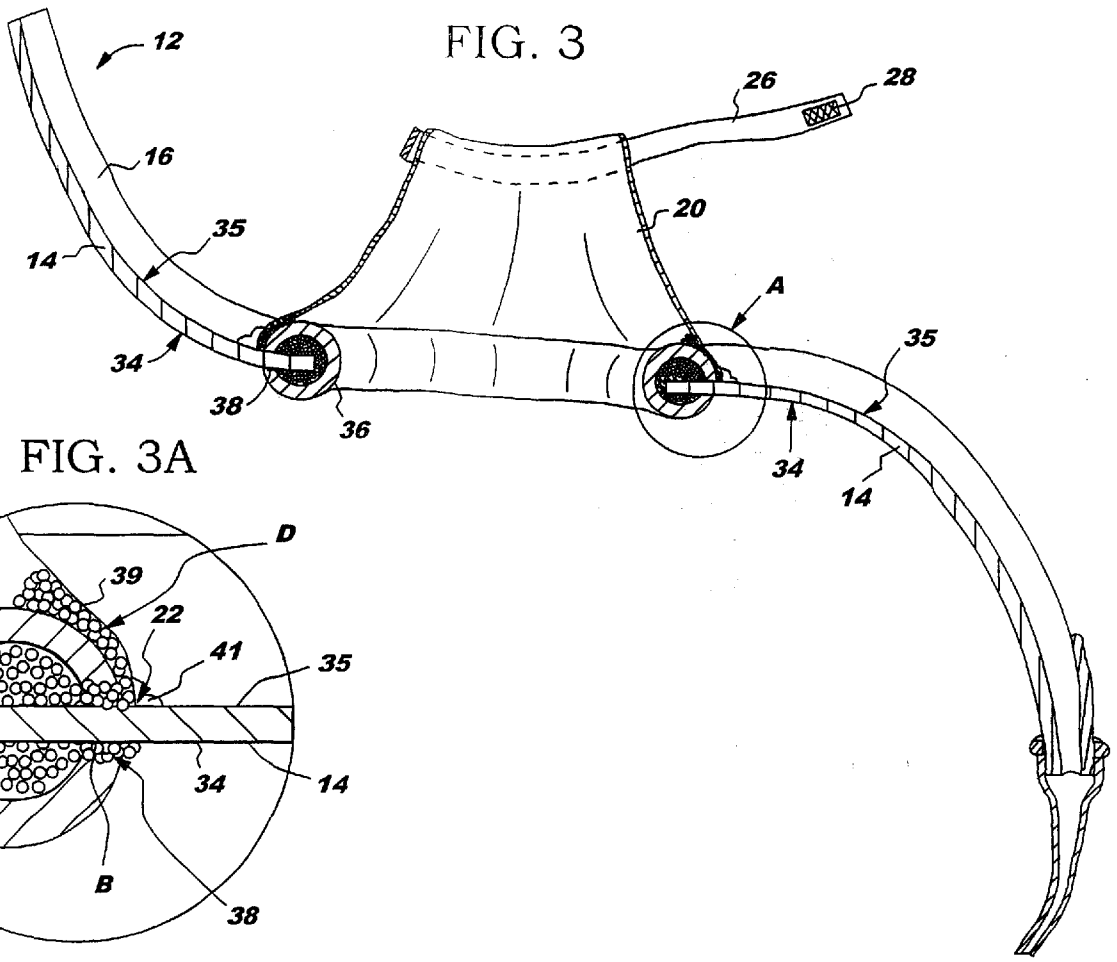
Figure 3A:
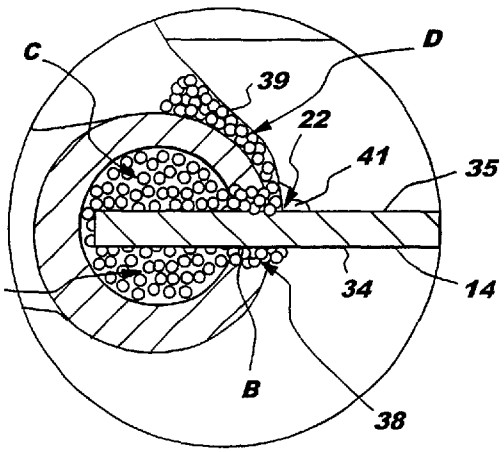
Figure 4:
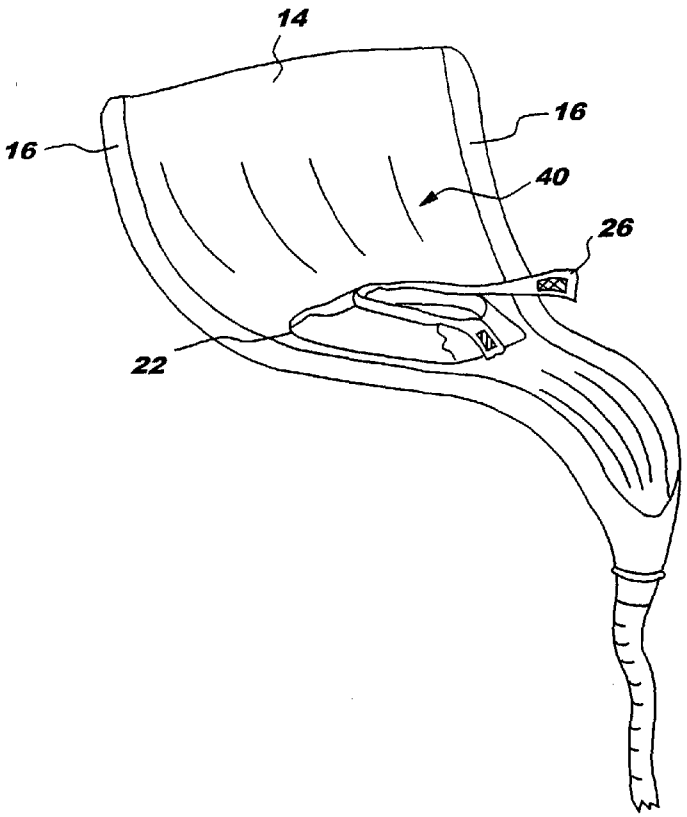
Figure 5:
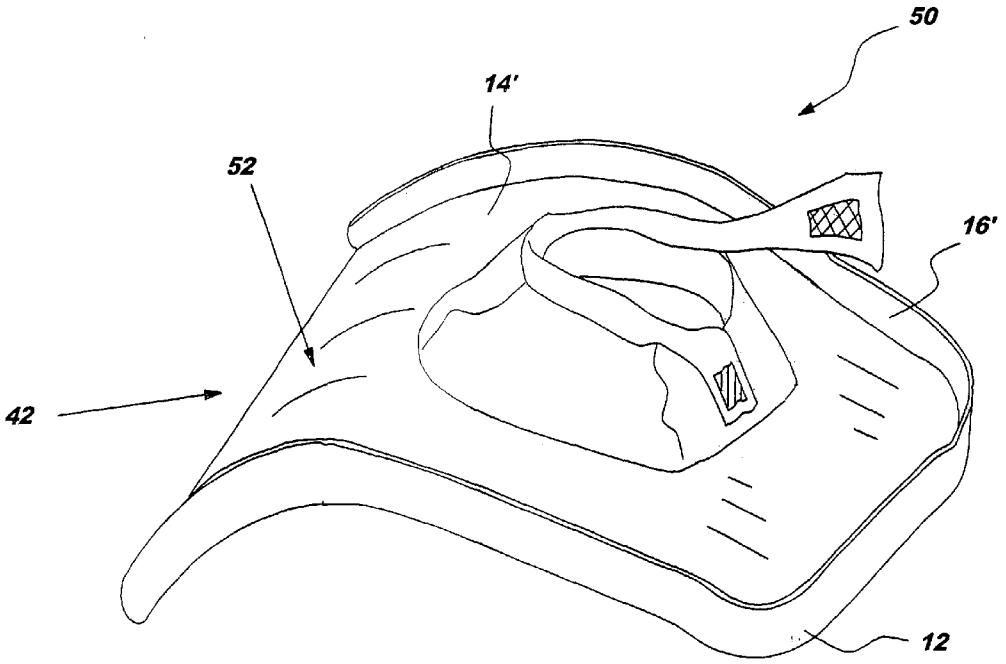
Figure 6:
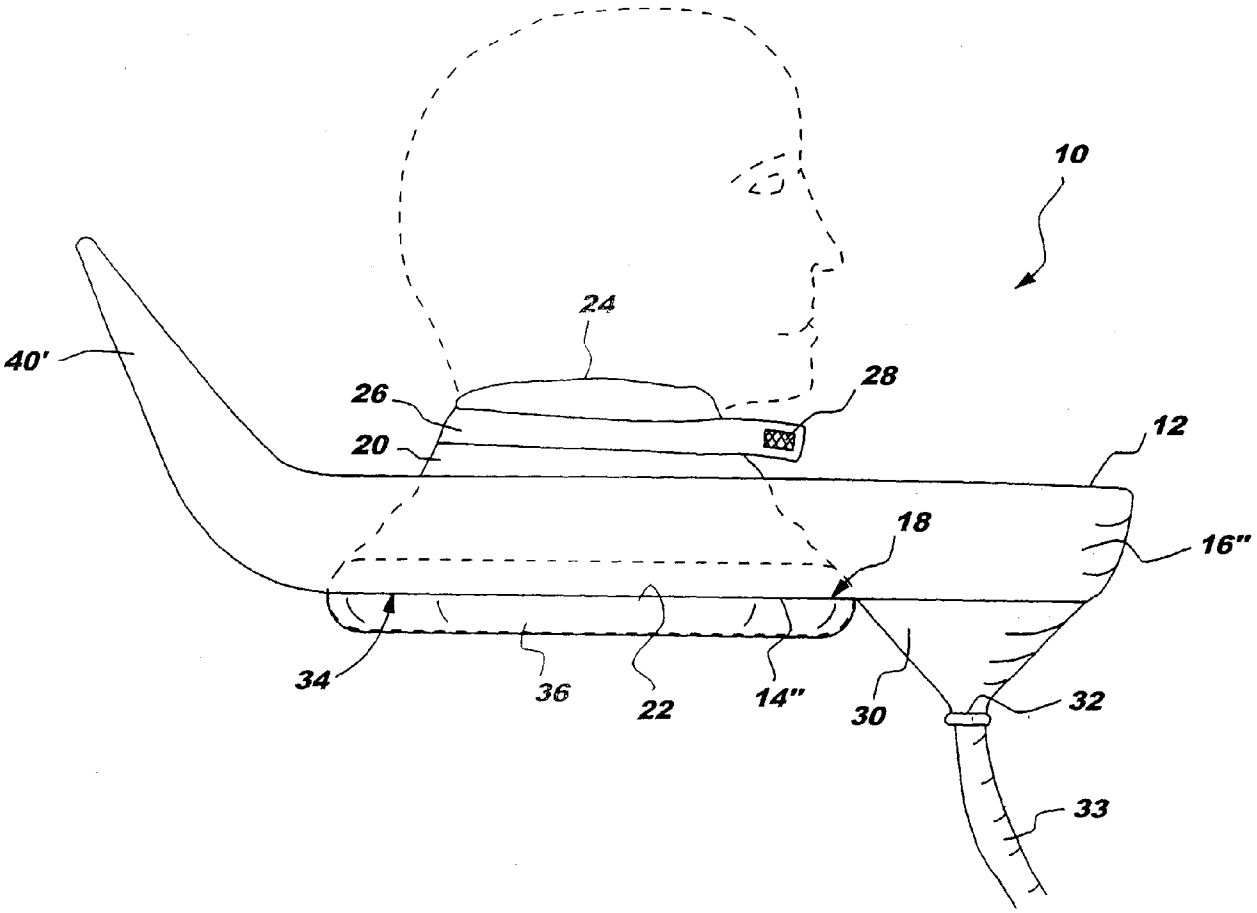

FIG. 6 is a side elevational view of an exemplary shampooing device in accordance with yet another embodiment of the present invention. Like parts are shown with corresponding reference numerals.

In the embodiment of FIG. 1, the bottom wall is curved to define a shield portion 40 extending above a major portion of the sidewall 16, as best shown in FIG. 4. In the embodiment shown in FIG. 6, the sidewall 16" defines the shield portion 40". Preferably, the shield portion 40 extends approximately 10 inches above the bottom wall 14" to catch liquids splashing from the patient's head during the shampooing process.

In use, the shampooing device 10 of FIG. 1 is first placed over a patient, allowing the patient's head to pass through the central opening 18 in the bottom wall 14 of the basin 12 and the cushion 36 to rest comfortably on the patient's shoulders. The shield 40 should be positioned behind the patient's head (as shown in FIG. 1) to catch any overspray of water during the shampooing process. The sleeve 20 may have to be stretched over the patient's head. In an embodiment with a collar, this will not likely be necessary. The collar 26 is then tightened and the fastener 28 is secured so that the sleeve 20 forms a tight seal with the patient's neck as high as possible, preferably just below the patient's chin. If applicable, the drainage tube 33 should be fastened to the basin 12, e.g. at funnel portion 30, and the distal end (not shown) of the drainage tube 33 should be placed in an appropriate receptacle or drain.

The patient's hair may then be washed. Water draining down over the seal where the sleeve 20 meets the patient's neck is not likely to cause a leakage problem, due to the elasticity of the sleeve 20 and/or the tightness of the collar 26. Additionally, any such water will immediately drain past the seal and collect in the basin, which substantially reduces any leakage risk. Water is not permitted to collect or "stand" along the seal. Since the seal of the sleeve 20 with the basin 12 is fixed, although this seal may be immersed, leakage is impossible unless the shampooing device 10 becomes damaged. Water collecting in the basin 12 then drains into the funnel portion 30 and is diverted through the drainage tube 33. In this manner, the seal with the patient's neck is maintained above the height of the sidewalls 16 of the basin 12 and therefore at all times above any standing water collected by the basin 12, which substantially reduces any leakage risk.

After shampooing, the collar's fastener 28 is released and the device 10 is passed back over the patient's head and removed from the patient's body.

What is claimed is:

1. A portable shampooing device for resting on the shoulders of a user, the device comprising:

a rigid basin defining a central opening;

a sleeve of elastic, liquid impermeable material, said sleeve defining a first periphery joined to said basin around said opening to form a liquid impermeable seal with said basin, said sleeve further defining a second periphery smaller than said first periphery; and an elastic collar strap integrally formed with said sleeve and having first and second ends, said first end of said collar strap being joined to said sleeve adjacent said second periphery, said second end of said collar strap comprising a fastener for adjustably securing said second end of said collar strap to adjustably constrict said second periphery of said sleeve to form a seal around the user's neck.

2. The device of claim 1, wherein said basin defines a bottom wall and wherein said sleeve is capable of extension above said bottom wall.

3. The device of claim 1, wherein said central opening of said basin is dimensioned to permit passage therethrough of a human head, and wherein said second periphery of said sleeve is dimensioned to permit expansion of said periphery to fit over said human head and contraction of said periphery to snugly fit a human neck.

4. The device of claim 1, wherein said sleeve is constructed of a hypoallergenic material.

5. The device of claim 1, wherein said collar strap is constructed of a hypoallergenic material.

6. The device of claim 5, wherein said fastener comprises hook and loop fastener material.

7. The device of claim 1, further comprising a cushion joined to said basin adjacent said central opening so as to rest on the user's shoulders, said cushion comprising a curved loop having a first end joined to one side of a bottom wall of said basin, and a second end joined to an opposite side of said bottom wall;

whereby a hard edge of said rigid basin defining said central opening is enclosed by said cushion.

8. The device of claim 7, wherein said cushion comprises closed cell foam.

9. The device of claim 1, said basin further comprising a continuous sidewall defining a perimeter of said basin and a second opening for draining said basin.

10. The device of claim 9, further comprising a drainage tube attached to said basin around said second opening.

11. The device of claim 9, wherein said basin defines a funnel portion and wherein said second opening is defined by said funnel portion, said drainage tube being attached to said funnel portion.

12. The device of claim 11, wherein said drainage tube is removably attached to said funnel portion.

13. The device of claim 9, wherein said sidewall defines a shield portion extending above a major portion of said sidewall, said major portion extending a substantially consistent height above a bottom wall of said basin.

14. The device of claim 1, further comprising a collar joined to said sleeve adjacent said second periphery and having a fastener comprising hook and loop material for securing said collar.

15. The device of claim 1, wherein said sleeve is bonded to said basin to form said liquid impermeable seal.

16. A portable shampooing device for resting on the shoulders of a user, the device comprising:

a rigid basin having a bottom wall and a sidewall extending upwardly along at least a portion of said bottom wall, said basin defining a centrally-located first opening and a second opening for draining said basin, said bottom wall comprising a first portion curving upwardly from said first opening, and a second portion curving downwardly from said first opening, said second opening being positioned along said second portion; and a sleeve of elastic, liquid impermeable material, said sleeve defining a first periphery joined to said basin around said first opening to form a liquid impermeable seal with said basin, said sleeve further defining a second periphery smaller than said first periphery for fitting closely around the user's neck.

17. The device of claim 16, wherein said sidewall is continuous, said device further comprising a drainage tube attached to said basin around said second opening.

18. The device of claim 17, wherein said bottom wall defines a funnel portion and wherein said second opening is defined by said funnel portion, said drainage tube being attached to said funnel portion.

19. The device of claim 18, wherein said drainage tube is removably attached to said funnel portion.

20. The device of claim 16, said device further comprising a cushion joined to said bottom wall adjacent said first opening so as to rest on the user's shoulders, said cushion comprising a curved loop having a first end joined to one side of said bottom wall, and a second end joined to an opposite side of said bottom wall;

whereby a hard edge of said rigid basin defining said first opening is enclosed by said cushion.

21. A portable shampooing device for resting on the shoulders of a user, the device comprising:

a rigid basin having a bottom wall and a continuous rigid sidewall extending upwardly along said bottom wall, said bottom wall defining a centrally-located first opening;

a sleeve of elastic, liquid impermeable material, said sleeve defining a first periphery joined to an inner surface of said basin around said first opening to form a liquid impermeable seal with said basin, said sleeve further defining a second periphery smaller than said first periphery, said second periphery being capable of fitting closely around the user's neck; and a cushion joined to said bottom wall to overlap an entire edge of said rigid basin that defines said first opening, said cushion being disposed to rest on the user's shoulders.

22. The device of claim 21, wherein said rigid basin further comprises a funnel portion defining a second opening.

23. The device of claim 21, wherein said bottom wall of said rigid basin comprises a flat portion having a cross-section that is substantially flat, said first opening being positioned within said flat portion, and a curved portion adjacent said substantially flat portion, said curved portion having a cross-section that is curved away from said flat portion.

24. The device of claim 21, wherein said cushion comprising a curved loop having a first end joined to one side of said bottom wall, and a second end joined to an opposite side of said bottom wall.

* * * * *

UNITED STATES PATENT AND TRADEMARK OFFICE

CERTIFICATE OF CORRECTION

PATENT NO. : 6,415,458 B1
DATED : July 9, 2002
INVENTOR(S) : Mc Fadden

It is certified that error appears in the above-identified patent and that said Letters Patent is hereby corrected as shown below:

Title page,
The title page showing the illustrative figure should be deleted and substitute therefore the attached title page.

Drawings,
Sheets 1-6, consisting of Figs. 1-6, should be deleted and substitute therefore the corrected Figs. 1-6, as shown on the attached pages.

Signed and Sealed this

Twenty-first Day of January, 2003

JAMES E. ROGAN
*Director of the United States Patent and Trademark Office*

(12) United States Patent
McFadden

(10) Patent No.: US 6,415,458 B1
(45) Date of Patent: Jul. 9, 2002

(54) SHAMPOOING DEVICE

(76) Inventor: Christopher P. McFadden, 2676 Salmon St., Philadelphia, PA (US) 19125

( * ) Notice: Subject to any disclaimer, the term of this patent is extended or adjusted under 35 U.S.C. 154(b) by 0 days.

(21) Appl. No.: 09/803,820

(22) Filed: Mar. 12, 2001

(51) Int. Cl.[7] ..... A45D 44/08
(52) U.S. Cl. ..... 4/521; 4/520
(58) Field of Search ..... 4/520, 521, 519, 4/518, 515, 523; 2/174, 171, 50, 48

(56) References Cited

U.S. PATENT DOCUMENTS

| | | | | | |
|---|---|---|---|---|---|
| 121,921 | A | | 12/1871 | Winn | |
| 835,814 | A | * | 11/1906 | Dalton | 4/521 |
| 1,429,950 | A | * | 9/1922 | Rose et al. | 4/515 |
| 1,438,099 | A | * | 12/1922 | De Velasco | 4/521 |
| 2,850,742 | A | | 9/1958 | Glintz | |
| 3,996,946 | A | * | 12/1976 | Craig | 132/9 |
| 4,014,054 | A | | 3/1977 | Pasquarello | 4/159 |
| 4,216,551 | A | | 8/1980 | Pasquarello | 4/521 |
| 5,022,102 | A | | 6/1991 | Louvaris | 5/516 |
| 5,146,629 | A | | 9/1992 | Barnes | 2/174 |
| 5,305,481 | A | | 4/1994 | Nebb | 4/516 |
| 5,551,088 | A | | 9/1996 | Stepp | 2/174 |
| 5,946,745 | A | | 9/1999 | Magee | 4/522 |
| 5,953,768 | A | | 9/1999 | Jarosz et al. | 4/522 |

FOREIGN PATENT DOCUMENTS

| | | | | |
|---|---|---|---|---|
| FR | 2600871 A1 | * | 1/1988 | 4/521 |

* cited by examiner

*Primary Examiner*—Gregory Huson
*Assistant Examiner*—Huyen Le
(74) *Attorney, Agent, or Firm*—Synnestvedt & Lechner LLP

(57) ABSTRACT

A portable shampooing device includes a basin defining a central opening and a sleeve of elastic, liquid impermeable material. The sleeve defines a first periphery joined to the basin around the opening for admitting passage of a human head. The sleeve also defines a second periphery smaller than the first periphery for fitting around a human neck, preferably at the chin or just below the chin. Optionally, the basin may define a funnel portion and include a drainage tube attached to the funnel portion. The device may also include a collar joined to the sleeve adjacent the second periphery and having a fastener for securing the collar around the neck and forming a tight seal. A cushion may be joined to the basin to provide comfort to a wearer of the shampooing device.

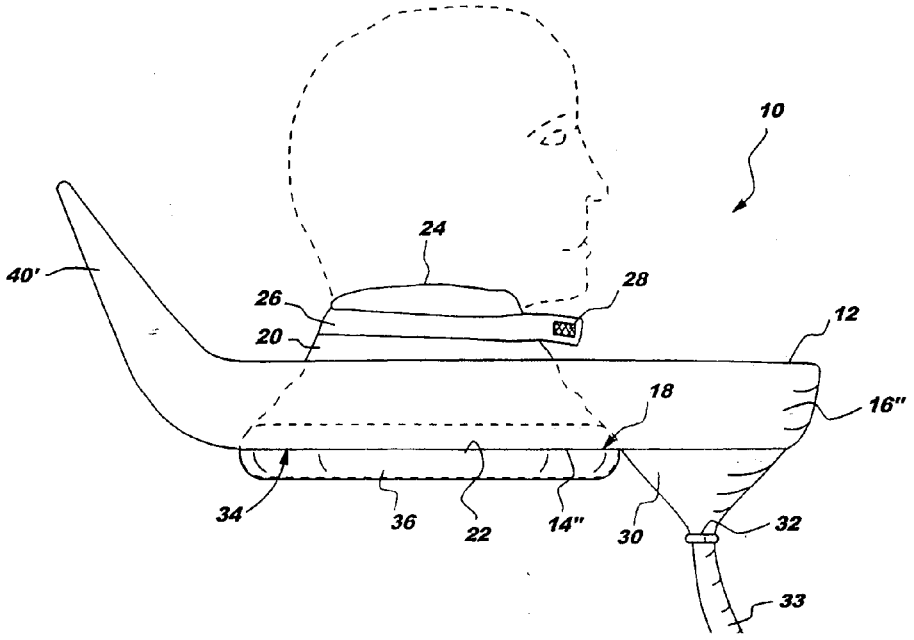

24 Claims, 6 Drawing Sheets